US005161488A

United States Patent [19]

Natter

[11] Patent Number: 5,161,488

[45] Date of Patent: Nov. 10, 1992

[54] SYSTEM FOR PURIFYING CONTAMINATED AIR

[75] Inventor: Arthur Natter, Wolfurt, Austria

[73] Assignee: Koenig AG, Arbon, Switzerland

[21] Appl. No.: 784,942

[22] Filed: Oct. 31, 1991

[30] Foreign Application Priority Data

Oct. 31, 1990 [CH] Switzerland ..... 3454/90

[51] Int. Cl.[5] ..... F22B 33/00

[52] U.S. Cl. ..... 122/1 R; 122/149; 236/14; 431/5

[58] Field of Search ..... 122/1 R, 1 A, 1 C, 149; 431/5; 422/182; 236/14

[56] References Cited

U.S. PATENT DOCUMENTS 4,627,388 12/1986 Buice .
4,716,843 1/1988 Coerper, Jr. et al. ..... 110/234
4,890,581 1/1990 Natter .
4,989,549 2/1991 Korenberg ..... 122/149

FOREIGN PATENT DOCUMENTS 0101372 2/1984 European Pat. Off. .
0212245 3/1987 European Pat. Off. .
280919 10/1913 Fed. Rep. of Germany .
434362 9/1926 Fed. Rep. of Germany .
1034190 7/1958 Fed. Rep. of Germany .
3025948 7/1982 Fed. Rep. of Germany .
231142 5/1926 United Kingdom .

*Primary Examiner*—Edward G. Favors
*Attorney, Agent, or Firm*—Spencer, Frank & Schneider

[57] ABSTRACT

A steam boiler (2) including a fire tube (21) and convection heating surfaces (22) is preceded by a combustion chamber (30) including a surface burner (34) for high excess air. The combustion chamber (30) and the fire tube (21) are internally thermally insulated (33). The combustion air supply opening (37) of the burner (34) is connected by way of a blower (40) with an exhaust air source (1). A fuel control valve (36) is controlled as a function of the boiler load. A plurality of heat exchangers (47, 48, 49) are incorporated in the flue gas channel (45) following the convection heating surfaces (22). The most upstream heat exchanger (47) is connected on the water inlet side by way of a pump (51) to the water chamber (23) and on the water outlet side by way of a baffle (53) to the water-steam circuit of the boiler (2). With this system it is possible to purify all of the exhaust air from the exhaust air source (1) over a broad boiler (2) load range.

10 Claims, 5 Drawing Sheets

40
off delay
71
35
36
68
feedback
65
109
servo amp
67
107
108
127
1
126
123
106
113
F/F
S
R
O1
O2
122
120
125
101
105
115
112
C3
C2
C4
C1
1250°
650°
Tmax
Tmin
P2
P3
Pmax
121
124
104
114
111
72
70
69
66
T
P $T_G$
72
$T_1$
69
$T_2$
70
P
66
n
$T_{min}$
$T_{max}$
ΔT
71
40
s
103
102
110
$P_1$
$P_2$
$P_3$
$P_{max}$
P
67
68

P
68
161
165
164
163
169
166
167
162
168
170
171
172
C
NO
NC
67
off delay
160
40
air
36
fuel

SYSTEM FOR PURIFYING CONTAMINATED AIR

CROSS REFERENCE TO RELATED APPLICATION

This application claims the priority of Swiss Application No. 3454/90-6 filed Oct. 31, 1990, which is incorporated herein by reference.

BACKGROUND OF THE INVENTION

This invention relates to a system for purifying contaminated air.

A system for purifying contaminated air is disclosed in U.S. Pat. No. 4,890,581. In this system, the exhaust air from a tenter is fed as combustion air to the burner of a steam boiler. The burner is operated with a variable excess of air which depends on the load. In deviation from the usually desired lowest possible amount of excess air, the excess air is increased with decreasing boiler load. In this way it is possible in many cases, in spite of varying boiler loads, to purify all of the exhaust air from the tenter. Additionally this method reduces energy consumption and improves efficiency. Therefore, this system has been found to be very satisfactory. In principle it is also suitable for purifying the exhaust air from other sources than from tenters or singeing equipment.

However, in practical operation of systems constructed according to U.S. Pat. No. 4,890,581 it has been found that the actually desirable upper excess air limit of $\lambda=3.5$ cannot be realized because the purifying effect is insufficient if the amount of excess air is very high. Therefore, in practical operation the upper excess air limit had to be kept at approximately $\lambda=2.5$. In certain cases, where there is a greatly fluctuating boiler load or where the boiler is loaded only slightly, this is not sufficient.

In such cases it was therefore necessary to fall back to the prior art thermal afterburning process according to VDI [Association of German Engineers] Guideline 2442 of June, 1987. In this afterburning system, crude gas is heated by means of a surface burner to about 800° C. and is then cooled again by means of a heat exchanger. The fuel supply is regulated in such a way that the temperature in the combustion chamber is kept constant at 800° C. The combustion chamber is a non-insulated steel pipe around whose exterior the crude gas flows. The pipe thus acts as the last stage of the heat exchanger. In the heat exchanger the crude gas to be purified is heated up to almost 600° C. so that fuel costs can be kept as low as possible. Such systems are expensive and have hardly any utility value except for reducing pollution. The exhaust heat still contained in the gas can rarely be used economically in an appropriate manner. Moreover, the gas-gas heat exchanger operated at a high temperature poses considerable material problems so that frequently a temperature higher than 800° C. which would actually be desirable cannot be employed.

A surface burner for such afterburning systems is disclosed in DE-A-3,025,948. These burners are operated in that crude gas at a temperature up to almost 600° C. flows around them and they are designed for a constant combustion temperature of about 800° C. They are not suitable as conventional steam boilers operated with flame temperatures up to almost 1800° C.

EP-A-0,212,245 discloses a system for burning halogen-ized hydrocarbons. The fire tube of a steam boiler is preceded by an internally insulated combustion chamber into which opens a special burner. The burner receives combustion air, fuel, the contaminants to be combusted as well as an atomizing fluid. The burner is operated at a constant flame temperature of about 1800° C.

SUMMARY OF THE INVENTION

It is an object of the present invention to provide an improved system for purifying contaminated exhaust air that is able to purify all of the available exhaust air over a broad steam load range.

The inventive system for purifying the exhaust air from an exhaust air source comprises:

(a) a steam boiler equipped with a fire tube and convection heating surfaces surrounded by water;

(b) an internally thermally insulated combustion chamber connected to the fire tube, with the interior insulation of the combustion chamber extending over at least part of the fire tube;

(c) a cone or surface burner opening into the combustion chamber for operation with a large amount of excess air;

(d) a fuel regulating valve connected with the burner and controlled by a control device;

(e) a combustion air blower which, at the pressure side, is connected with the combustion chamber and, at the suction side, is connected by way of a conduit with the exhaust air source;

(f) a flue gas channel connected to the convection heating surfaces of the steam boiler; and (g) a gas-water heat exchanger installed in the flue gas channel and connected on the water side with the steam boiler.

In the solution according to the invention, in contrast to afterburning systems, the fuel supply to the burner is not regulated as a function of the combustion chamber temperature but as a function of the steam load. In contrast to the prior art afterburning systems and steam boilers, the combustion chamber is thermally insulated in its interior. Compared to a conventional steam boiler, the boiler of the system according to the invention, because of the high excess of air, has a considerably larger flue gas throughput for the same output. According to conventional criteria, it is thus over-dimensioned for its output. It becomes economical if this increased flue gas quantity at a temperature of about 250° C. when leaving the boiler is cooled to at least the temperature of the incoming exhaust air, if possible to below the dew point, with recovery of this waste heat.

A pilot system was able to allay initial fears that a commercially available cone burner would fail at the varying combustion chamber temperatures of up to almost 1300° C. which are required because of the fluctuating boiler load. Such burners are usually recommended only for a combustion temperature of less than about 900° C. The fact that the commercially available burner operates properly in spite of the sometimes considerably higher temperature is explained in that, according to the invention, the exhaust air of about 130° C. flowing around it is considerably cooler than the crude gas for the purification of which such burners have been employed in the past and which has a temperature up to almost 600° C.

Preferably, the steam boiler is equipped with a sensor for a state variable of the steam contained in the steam boiler and the control device includes a regulator which, at its input, is connected with the sensor and, at its output, with the fuel control valve so that the fuel quantity is regulated as a function of the steam load of the steam boiler and, at least over a partial load range, independently of the incoming quantity of exhaust air.

Preferably the controller for the fuel control valve has a characteristic that includes a proportional range in which the closing movement of the control valve is proportional to the steam pressure within the boiler and a subsequent second range in which the valve is open to a minimal extent, with this opening remaining independent of the steam pressure. The second range is considerably broader with reference to the steam pressure than the proportional range. In that way it is possible to bridge periods of low steam discharge without shutting down the boiler and the connected emission of unpurified exhaust air. The energy generated during these periods is stored as an increase in the temperature of the boiler water and is then available to cover peak demands.

DESCRIPTION OF THE PREFERRED EMBODIMENTS

Figure 1:
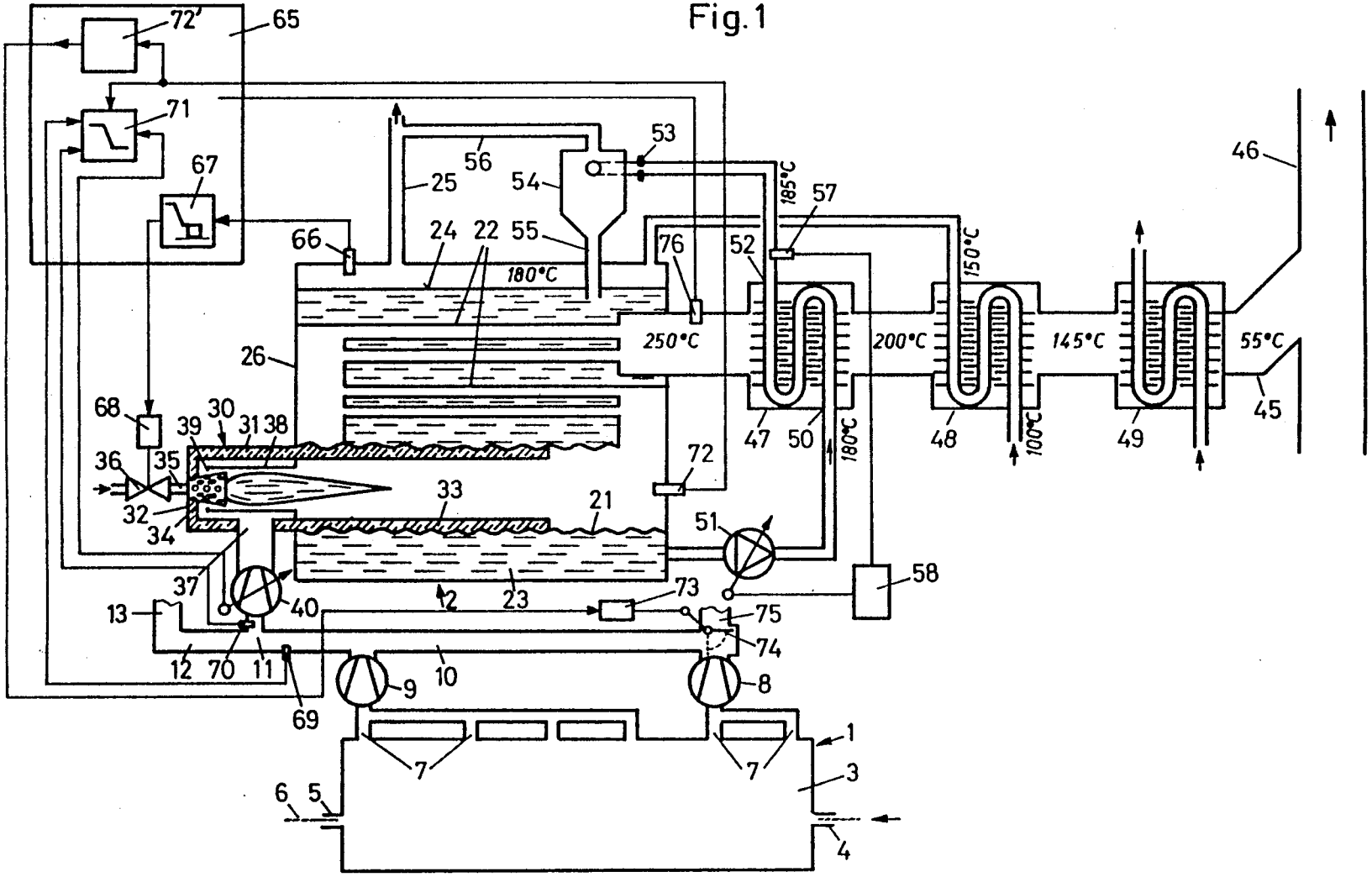
FIG. 1 is a schematic representation of a first embodiment.

The system according to FIG. 1 includes a tenter 1 and a three-pass steam boiler 2. The tenter 1 includes a housing 3 that is closed on all sides and has an entrance slot 4 as well as an exit slot 5 for a panel of cloth 6. The hot exhaust air loaded with organic contaminants in the interior of housing 3 is extracted by two blowers 8, 9 through six extraction pipes 7 and is introduced into boiler 1 through a thermally insulated common connecting conduit 10. At a branch point 11, a conduit 12 branches off from conduit 10 and leads to a compensation chimney 13. Boiler 2 includes a fire tube 21 and convection heating surfaces 22 in the form of bundled pipes which form the second and third passes. In operation, fire tube 21 and convection heating surfaces 22 are surrounded by boiling water 23. A steam port 25 is provided above water surface 24.

In conventional boilers of this type, the burner is mounted at the upstream end of fire tube 11 to the one end face 26 of boiler 2. In the system according to FIG. 1, however, a combustion chamber 30 is mounted to end face 26 and opens into fire tube 21. Combustion chamber 30 is composed of a cylindrical steel casing 31 and a cover 32 at its end face. Casing 31, cover 32 and at least the major portion of fire tube 21 are lined in their interiors with light-weight fire-clay bricks 33 or some other refractory material. A cone or surface burner 34 is mounted to cover 32. In contrast to conventional steam boiler burners, such burners have a plurality of small flames and are suitable for operation with large amounts of excess air. Such burners are employed, for example, in afterburning systems. An example of such a burner is the Eclipse Incini-Cone Burner sold by ECLIPSE COMBUSTION, Rockford, Ill., USA. The fuel nozzles of burner 34 are connected by way of a conduit 35 with a fuel valve 36. The supply of combustion air to burner 34 takes place through a radial entrance opening 37, a coaxial cylindrical pipe 38 and a profiled plate 39. Conduit 10 is connected with entrance opening 37 through a controllable blower 40.

A flue gas channel 45 connects the downstream end of convection heating surfaces 22 with a chimney 46. Three finned tube heat exchangers 47, 48, 49 are installed in channel 45. The inlet port 50 on the water side of the most upstream heat exchanger 47 is connected by way of a controllable pump 51 with the water chamber of boiler 2. The outlet port 52 is brought by way of a baffle 53 acting as a pressure reducing device to a separating device. The separating device is configured as a turbulence chamber 54, with the conduit from heat exchanger 47 opening tangentially into its cylindrical wall. Chamber 54 is connected to the water-steam circuit of boiler 2 by separate conduits 55, 56, respectively.

In heat exchanger 47, the water flowing through it is heated to above the boiling temperature at boiler pressure. In order to prevent the water from boiling within the pipes of heat exchanger 47, a temperature sensor 57 is applied at outlet port 52. The signal from this sensor 57 controls a controller 58 for pump 51 in such a manner that, at the temperature measured by sensor 57, the pressure of the water between pump 51 and baffle 53 is above the steam pressure. Downstream of baffle 53, some of the water evaporates. The separate introduction of water and steam downstream of turbulence chamber 54 makes it possible for the natural convection of the water in boiler 2 to occur with hardly any interference. In addition to or instead of controlling pump 51, pressure reducing device 53 may also be controllable. This heat exchanger 47 which operates at excess pressure makes it possible to recover part of the flue gas heat directly in the form of steam and to thus reduce the temperature of the flue gas from about 250° C. to about 200° C.

The second heat exchanger 48 serves to preheat the feed water. The quantity of water flowing through this heat exchanger 48 is only about 1/10 of the water flowing through heat exchanger 47; but the increase in temperature is about ten times higher so that, downstream of heat exchanger 48, the flue gas has a temperature of, for example, 145° C. The third heat exchanger 49 serves to heat utility water and/or fresh feed water.

A control device 65 serves to control the system. A pressure sensor 66 measures the steam pressure in boiler 2 and controls by way of a proportional controller 67 a servomotor 68 for fuel valve 36 in such a manner that fuel valve 36 opens when the boiler pressure drops. However, the supplying of combustion air to burner 30 is effected, at least in an average load range of boiler 2, independently of the boiler load. Rather, blower 40 is regulated in such a manner that a small quantity of fresh air is sucked in constantly through compensation chimney 13. This prevents contaminated exhaust air from escaping through chimney 13. For this purpose, a temperature sensor 69, 70, respectively, is installed in conduit 10 upstream and downstream of branch point 11. The two sensors 69, 70 are connected with a further proportional controller 71. The latter is set to maintain a temperature difference of about 5° C. across branch point 11. If this temperature difference drops, controller 71 increases the number of revolutions of blower 40.

Controller 71 has a variable lower and upper limit. Both limits are controlled by a temperature sensor 72 at the end of fire tube 21. At this point, the temperature should not exceed about 1250° C. which constitutes the lower limit for the required supply of combustion air. On the other hand, the temperature should not drop to below, for example, 650° C. in order to ensure that all contaminants of the exhaust air are combusted. This puts an upper limit on the blower output. If the boiler load is high and valve 36 is open wide, additional fresh air can be sucked in through chimney 13. If the boiler load is very small, however, some exhaust air is able to escape through chimney 13.

If this is undesirable, a temperature actuated switch 72', a servomotor 73 and a flap 74 can be employed, for example, to cut off the first two fields of tenter 1, which were vacuumed by means of blower 8, from conduit 10 and thus reduce the supply of air to blower 40. The exhaust air from the first two fields is significantly less contaminated than the exhaust air from the remaining fields and is therefore more suitable to be conducted outside through a chimney 75.

However, depending on the case at hand, it is also possible for the total discharge of contaminants to be lower without the two above-mentioned measures than with one or the other of these measures. In such a case, the upper limit for controller 71 is omitted as are switch 72', flap 74 and chimney 75.

The thermally insulating lining 33 of chamber 30 and fire tube 21 make it possible to prevent the occurrence of cold zones within fire tube 21 so that the temperature of the exhaust gases is approximately equal over the entire fire tube cross section. Thus, the excess of air can be significantly increased compared to that of the above-mentioned system. Surface burner 34 permits reliable combustion with this high excess of air even if the exhaust air is low in oxygen down to 13% $O_2$, for example, if the exhaust air contains much steam or other inert gases. Such exhaust air is not suitable as combustion air for conventional steam boiler burners.

The extent to which fire tube 21 is insulated depends primarily on the load range of boiler 2 to be expected in operation compared to its rated load. If boiler 2 carries only a small load, the entire fire tube 21 will be lined so that the system is able to operate with a higher excess of air. If, however, the average load is greater, more or less of the downstream end of fire tube 21 will be left unlined so that the system can be operated with higher combustion chamber temperatures. In this unlined section of fire tube 21, the flue gas is cooled by radiation onto the cooled fire tube wall.

In the subsequent figures the same components bear the same reference numerals so that a detailed description of these components should not be necessary.

Figure 2:
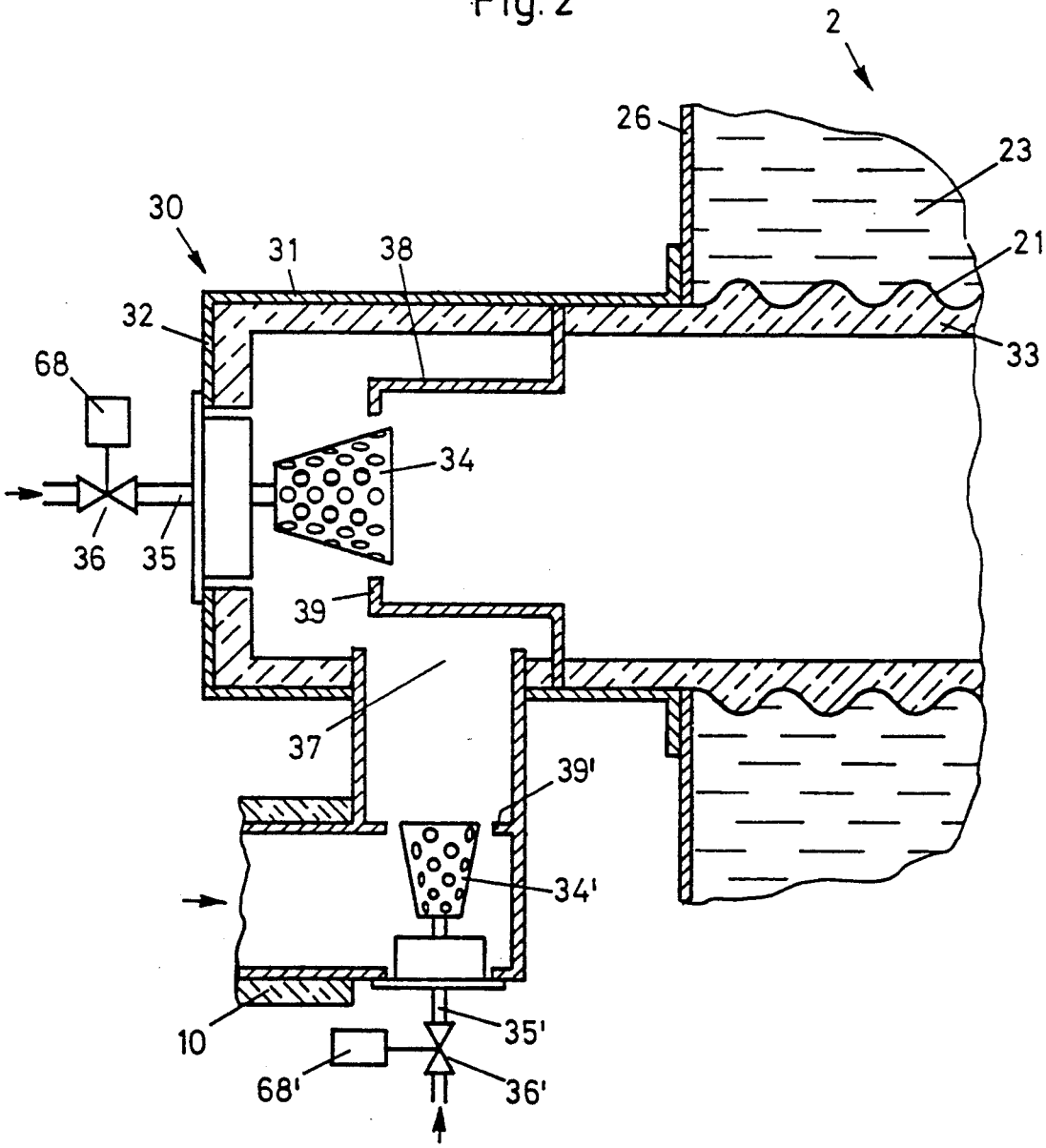
FIG. 2 is a partial illustration of a variation of the embodiment of FIG. 1.

FIG. 2 shows part of a variation of the embodiment of FIG. 1. The variation according to FIG. 2 differs from the embodiment according to FIG. 1 in that combustion takes place in two stages. Burner 34 is preceded by an identical surface burner 34'. This results in better mixing of the exhaust air with the combustion products of burner 34 and thus in a better constancy of the temperature over the cross section of fire tube 21.

In the embodiments according to FIGS. 1 and 2, a waste heat steam boiler without fire tube 21 is also suitable in principle instead of the three-pass steam boiler 2. In that case, the internally thermally insulated combustion chamber 30 is extended correspondingly. In contrast to the conventional waste heat steam boilers whose load is not controllable and which can therefore be employed only in conjunction with an additional conventional steam boiler, the load control according to the invention makes it possible to meet a varying requirement for steam and thus omit this additional steam boiler.

The two limitations of controller 71 may also be controlled, instead of by temperature sensor 72, by means of an exhaust gas sensor 76 in flue gas channel 45. Exhaust gas sensor 76 may measure, for example, the $O_2$ content or the CO content of the exhaust gases and ensure by way of the limitation in controller 71 that a minimum $O_2$ content will always be maintained and a CO content limit value will not be exceeded.

Figure 3:
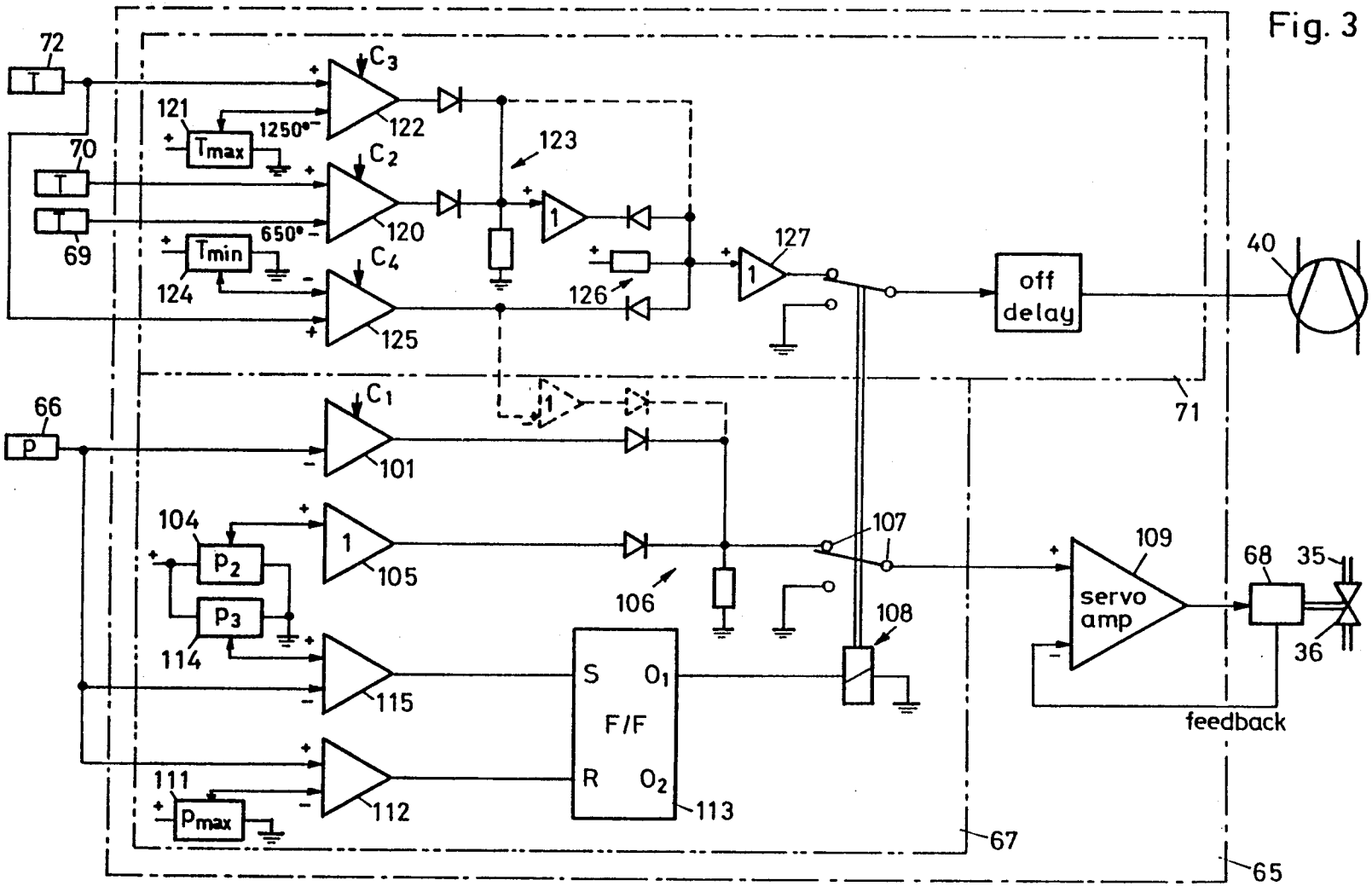
FIG. 3 is a schematic representation of a control device.

FIG. 3 shows an example of a switching scheme for control device 65, with temperature switch 72' being omitted here. The illustrated example shows a control by means of electronic analog components. However, the same functions, whose characteristics are shown in FIG. 4, may also be realized by means of a digital controller or by means of mechanical/pneumatic components.

Figure 4:
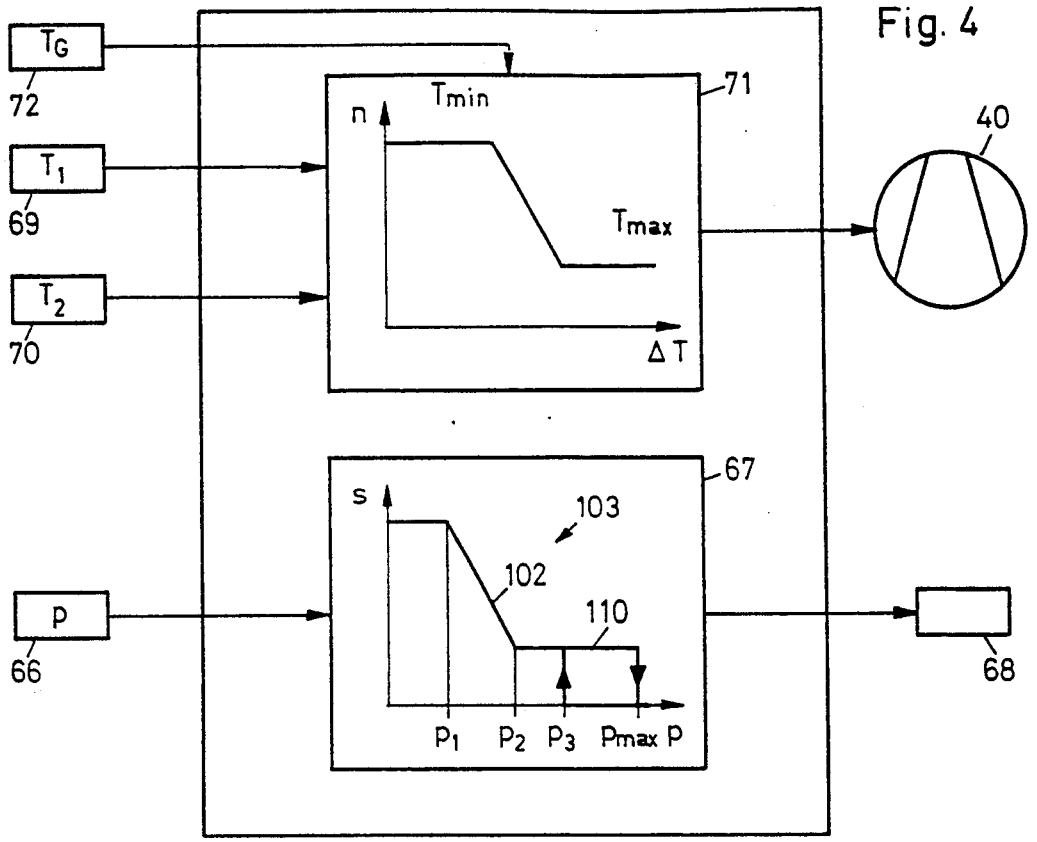
FIG. 4 is a schematic representation including the characteristics of the control elements.

The signal from steam pressure sensor 66 is connected in fuel controller 67 with the negative input of an amplifier 101 whose variable gain $C_1$ determines the slope of the proportional branch 102 of characteristic 103 of controller 67 (FIG. 4). A potentiometer 104 sets the minimum aperture of fuel valve 36 required to maintain the flame in burner 34. The value picked up at potentiometer 104 is amplified in an amplifier 105. The output of a diode circuit 106 is the higher output of the two amplifiers 101, 105. Diode circuit 106 is connected by way of the switch contacts 107 of a relay 108 to a servo amplifier 109 which controls servomotor 68. Thus, in normal operation, fuel valve 36 is closed proportionally with the increasing boiler pressure p from its fully open position at pressure $p_1$ until pressure $p_2$ and then remains at this minimum open position (branch 110 on characteristic 103) until the maximum pressure $p_{max}$ is reached. At this pressure $p_{max}$ which can be set at a potentiometer 111, the signal of sensor 66 actuates by way of a differential amplifier 112 the reset input R of a flip-flop 113. The one output $O_1$ of this flip-flop is released so that relay 108 switches to the grounding position and grounds the positive input of servoamplifier 109. This causes valve 36 to close completely. With a slight delay, blower 40 is also switched off. Boiler 2 is now shut down and any exhaust air that should still develop escapes through chimney 13.

As soon as boiler pressure p drops to below a value $p_3$ that can be set at potentiometer 114, the reset input S of flip-flop 113 is actuated by way of a further differential amplifier 115 and boiler 2 is put back into operation again, with of course the other functions required to turn on the burner, e.g. ignition, also being initiated.

In conventional boiler controls, shut-down occurs directly when the minimum load is reached, that is at pressure $p_2$. In the system according to the invention, however, the difference $p_{max}-p_2$ is selected to be as great as possible and significantly greater than $p_2-p_1$. This has the considerable advantage that during times of lower steam requirements boiler 2 is not shut down but stores the combustion energy generated during this period in boiler 2 by raising the temperature of the water.

If boiler 2 has, for example, a permissible excess pressure of 13 bar, which corresponds to a water temperature of 198° C., and if the normal operating range, that is, the proportional range 102, is selected to be from $p_1=6$ bar (corresponding to 166° C.) to $p_2=7$ bar (corresponding to 172° C.), it is possible to store approximately 260,000 Cal energy by way of a temperature difference of 20° C. for a water content of boiler 2 of 10 $m^3$; this corresponds to a steam discharge of about 540 kg. With such energy storage, the system according to the invention can also be employed in those cases where time periods without or with only a slight steam discharge occur during operation of the steam boiler.

The described energy storage has the additional advantage that, after such a period of low steam discharge, which is usually followed by a consumption peak, the boiler is able to cover this peak directly with the stored energy in that the corresponding quantity of steam is released immediately when the pressure is reduced to the normal range of $p_1$ to $p_2$.

FIG. 3 again shows controller 71 for controlling the number of revolutions n of blower 40. In normal operation, blower 40 is controlled by means of an amplifier 120 having a variable gain $C_2$ on the basis of the difference between the signals from temperature sensors 69, 70. If the temperature measured by sensor 72 rises to above a value of, for example, 1250° [C.] set by means of a potentiometer 121, an amplifier 122 takes over the control of the blower by way of a diode circuit 123 and provides for the supply of additional fresh air through compensation chimney 13. If, however, the temperature of sensor 72 drops to below a value of, for example, 650° C. set at a potentiometer 124, which just permits sufficient combustion of the contaminants to take place, amplifier 125 takes over the control of the blower by way of a further diode circuit 126. In that case, flap 74 may additionally be switched by means of temperature responsive switch 72'.

If no contaminants are allowed to be emitted, diode circuit 126 is omitted and the output of diode circuit 123 is connected directly with the input of amplifier 127. The output of amplifier 125 is then connected with diode circuit 106 by way of an inverter. This variation is shown in dashed lines in FIG. 3. In this variation, burner 34 receives all generated exhaust air and in region 110 of characteristic 103 a temperature of 650° C. is maintained in the turning chamber by controlling fuel valve 36. In that case, the heating energy during energy storage between $p_2$ and $p_{max}$ is generally higher so that it is possibly to bridge only shorter time periods without the discharge of steam.

Figure 5:
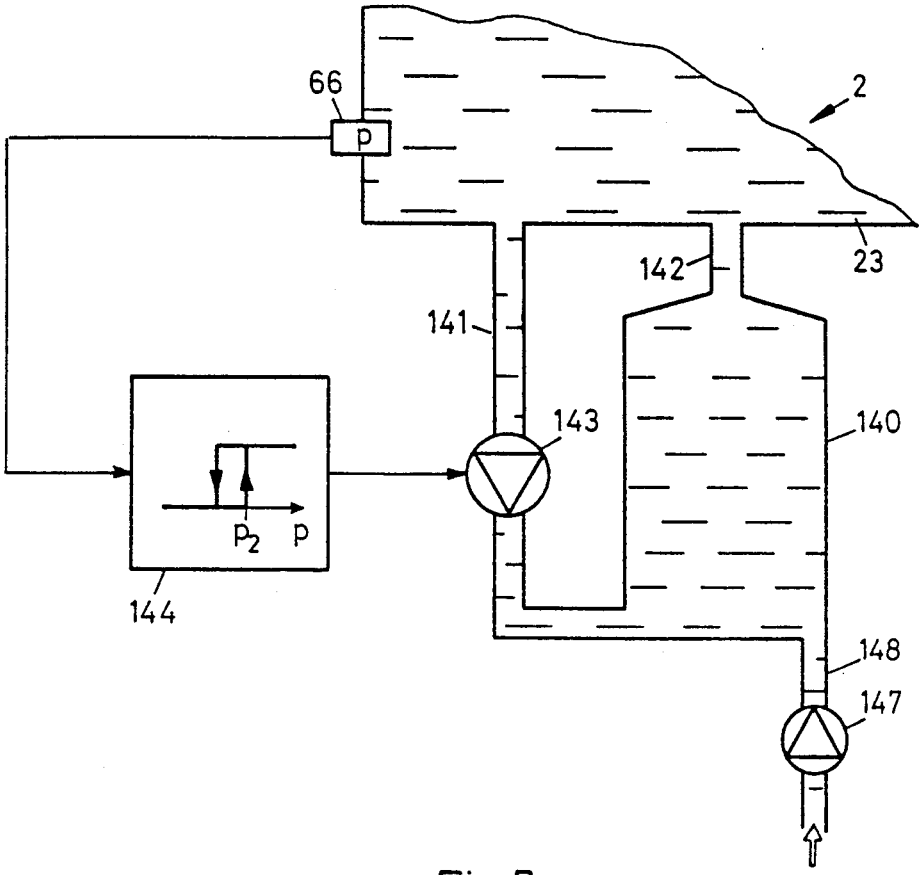
FIG. 5 is a partial view of a variation of the embodiment of FIG. 1.

FIG. 5 shows a variation to increase the energy storage capacity of boiler 2. An additional water container 140 is connected by means of two conduits 141, 142 to the water chamber of boiler 2. A circulating pump 143 is mounted in conduit 141. The pump is switched on by means of a pressure switch 144, whenever the boiler pressure p rises above the value $p_2$. The boiler feed water is not supplied directly into boiler 2 but into container 140, as shown in FIG. 5 by feed water pump 147 and feed conduit 148. In this way it is accomplished that during the energy storage phase between $p_2$ and $p_{max}$ the water in container 140 is heated, in addition to the boiler water 23, from the feed water temperature of, for example, 150° C. to, for example, 198° C. and thus the storage phase is extended.

Figure 7:
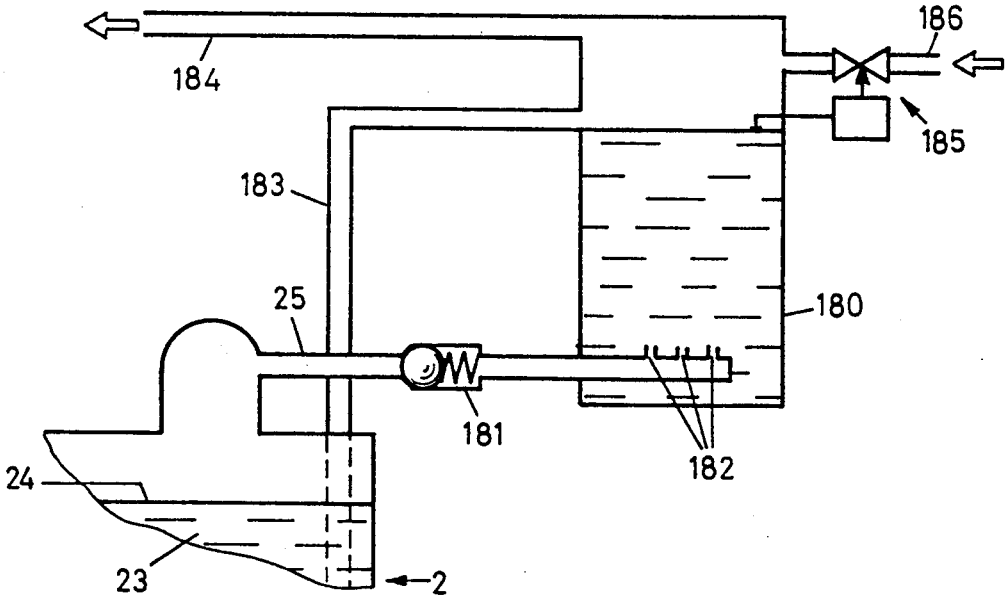
FIG. 7 is a partial view of a variation of the embodiment of FIG. 1.

FIG. 7 shows a simpler form of an energy store. Here, steam conduit 25 of boiler 2 is connected by way of a check valve 181 to several distributor nozzles 182 in the lower region of water container 180 An overflow conduit 183 leading into boiler 2 opens into the upper region. The main conduit 184 from the steam network is connected to container 180 above overflow conduit 183. In addition, a feed water supply conduit 186 may be connected to container 180 by way of a level controller 185. This embodiment requires no circulating pump. The water temperature in container 180 follows the water temperature in boiler 2.

If the available quantity of exhaust air varies only slightly, control device 65 may be simplified accordingly. Blower 40 may then run at a constant number of revolutions and its throughput may be set manually, for example by means of a choke 160, so that little fresh air is sucked in through chimney 13. In that case controller 71 is no longer required.

Figure 6:
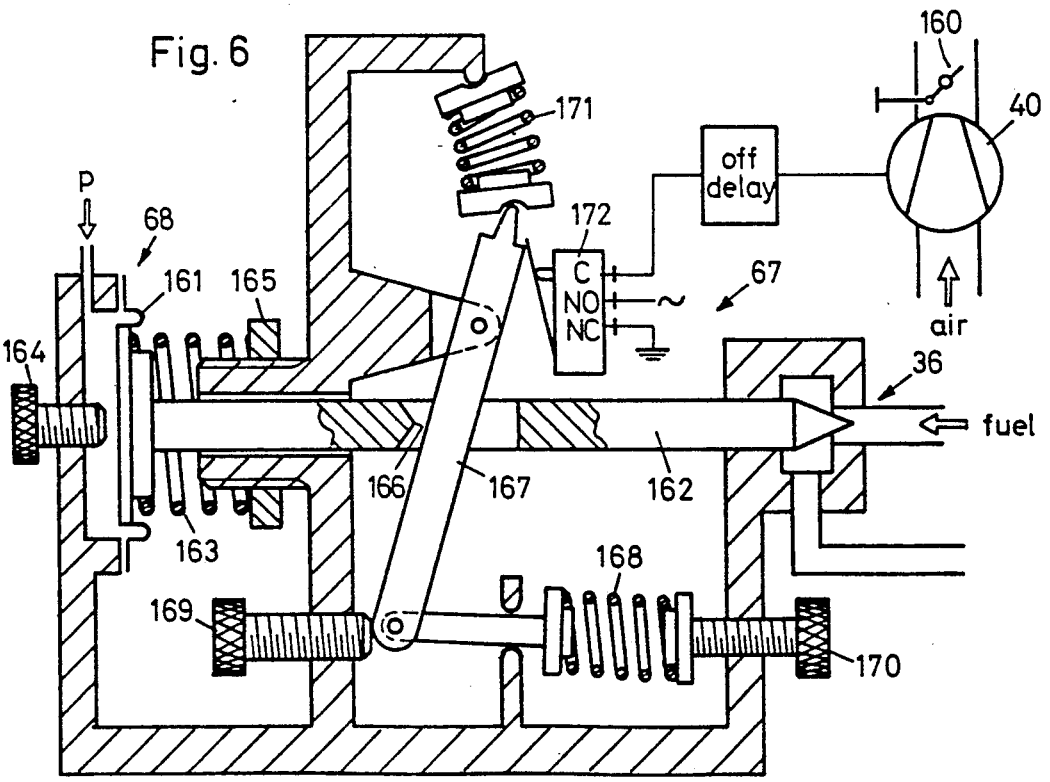
FIG. 6 is a schematic representation of a simplified control arrangement.

FIG. 6 shows a simplified mechanical embodiment of controller 67 for this case, which again has the characteristic 103 shown in FIG. 4. The boiler pressure p acts by way of a diaphragm 161 on valve member 162 of fuel control valve 36. A spring 163 urges valve member 162 against an abutment screw 164 with which the maximum valve opening is set so that, with a given quantity of exhaust air flowing to burner 34, the temperature in the first turning chamber does not exceed the permissible value of, for example, 1250° C. The bias of spring 163 set by means of a nut 165 determines the beginning $p_1$ of proportional range 102. At the end $p_2$ of this range, a tappet 166 of valve member 162 strikes a pivot lever 167, which is biased by a spring 168 into the illustrated basic position against an abutment screw 169. Screw 169 is used to set the minimum opening of valve 36 during the storage phase so that the combustion chamber temperature does not drop below, for example, 650° C. An adjustment screw 170 is employed to set the bias of spring 168 and thus the maximum pressure $p_{max}$ at which valve 36 shuts the system down. A knee lever mechanism including a biased spring 171 takes care of valve 36 being closed immediately when $p_{max}-p_3$ is reached. If lever 167 switches, blower 40 is also shut down with a slight delay by way of a limit switch !72.

It will be understood that the above description of the present invention is susceptible to various modifications, changes and adaptations, and the same are intended to be comprehended within the meaning and range of equivalents of the appended claims.

What is claimed is:

1. A system for purifying the exhaust air of an exhaust air source (1), comprising:

(a) a steam boiler (2) equipped with a fire tube (21) and convection heating surfaces (22) surrounded by water (23);

(b) an internally thermally insulated combustion chamber (30) connected to the fire tube (21), with the interior insulation (33) of the combustion chamber extending over at least part of the fire tube (21);

(c) a cone or surface burner (34) opening into the combustion chamber (30) for operation with a large amount of excess air;

(d) a fuel regulating valve (36) connected with the burner (34) and controlled by a control device (65);

(e) a combustion air blower (40) which, at the pressure side, is connected with the combustion chamber (30) and, at the suction side, is connected by way of a conduit (10) with the exhaust air source (1);

(f) a flue gas channel (45) connected to the convection heating surfaces (22) of the steam boiler (2); and (g) a gas-water heat exchanger (47, 48) installed in the flue gas channel (45) and connected on the water side with the steam boiler (2).

2. A system according to claim 1, wherein the steam boiler (2) includes a first sensor (66) for a state variable (p) of the steam contained in the steam boiler (2), and wherein the control device (65) includes a first controller (67) whose input is connected with the first sensor (66) and whose output is connected with the fuel control valve (36) and is configured in such a way that the fuel quantity is regulated over a partial load range of the steam boiler (2) as a function of the steam load of the steam boiler (2) and independently of the quantity of exhaust air supplied.

3. A system according to claim 2, wherein the control device (65) includes a second controller (71) which regulates, at least over a partial load range of the steam boiler (2), the throughput power of the blower (40) corresponding to the quantity of incoming exhaust air measured by a further sensor (69, 70).

4. A system according to claim 2, wherein the first controller (67) has a characteristic (103) in which, in a first range ($p_1$ to $p_2$) of the state variable (p), the closing movement (s) of the control valve (36) is analogous to the change in the state variable (p) and wherein, in a second range ($p_2$ to $p_{max}$) of the state variable (p), the closing movement (s) is independent of the state variable (p), with the second range being broader than the first range.

5. A system according to claim 4, wherein, in the second range, the closing movement of the control valve (36) is controlled by the flue gas temperature in the fire tube (21) in such a manner that a predetermined minimum temperature ($T_{min}$) is always maintained.

6. A system according to claim 1, wherein the heat exchanger is a finned tube heat exchanger (47) whose water side inlet port (50) is connected by way of a pump (51) with the water chamber (23) of the steam boiler (2) and whose water side outlet port (52) is connected by way of a pressure reducing device (53) with the water-steam circuit of the steam boiler (2).

7. A system according to claim 6, wherein the pressure reducing device (53) is followed by a separating device (54) for separating water and steam and the separating device (54) is connected by way of two separate conduits (55, 56) for water and steam, respectively, with the water-steam circuit of the steam boiler (2).

8. A system according to claim I, wherein a second cone or surface burner (34') is disposed upstream of the burner (34).

9. A system according to claim 1, wherein the exhaust air source (1) includes two extraction fans (8, 9) which convey exhaust air containing different contaminant concentrations into the common conduit (10) to the blower (40), and wherein a flap (74) is provided in the conduit (10) and a limit switch member (72) is provided in the control device (65), with said limit switch member separating the fan (8) that conveys the lower contaminant concentration from the conduit (10) by means of the flap (74), whenever a predetermined limit value ($T_{min}$) is not reached or is exceeded in the steam boiler (2).

10. A system according to claim 1, wherein an additional water container (140, 180) is connected as energy store to the water-steam circuit of the steam boiler (2).

* * * * *